US008085970B2

(12) United States Patent
Funahashi

(10) Patent No.: US 8,085,970 B2
(45) Date of Patent: Dec. 27, 2011

(54) SPEAKER DAMPER AND SPEAKER USING THE SAME

(75) Inventor: Osamu Funahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 444 days.

(21) Appl. No.: 11/573,720

(22) PCT Filed: Sep. 15, 2006

(86) PCT No.: PCT/JP2006/318398

§ 371 (c)(1),
(2), (4) Date: Feb. 15, 2007

(87) PCT Pub. No.: WO2007/034751

PCT Pub. Date: Mar. 29, 2007

(65) Prior Publication Data

US 2008/0317275 A1 Dec. 25, 2008

(30) Foreign Application Priority Data

Sep. 21, 2005 (JP) ..... 2005-273328
May 10, 2006 (JP) ..... 2006-131331

(51) Int. Cl.
*H04R 1/00* (2006.01)

(52) U.S. Cl. ..... 381/404; 381/396; 381/403

(58) Field of Classification Search ..... 381/404, 381/403

See application file for complete search history.

(56) References Cited

U.S. PATENT DOCUMENTS 2,905,260 A * 9/1959 Williams ..... 181/167
5,619,019 A * 4/1997 Yoshimura et al. ..... 181/166
6,655,495 B2 * 12/2003 Kuze et al. ..... 181/171
6,735,323 B1 5/2004 Chang
7,203,333 B2 4/2007 Funahashi et al.
7,209,570 B2 4/2007 Funahashi et al.
7,292,707 B2 * 11/2007 Kreitmeier et al. ..... 381/398
7,515,728 B2 * 4/2009 Kobayashi et al. ..... 381/398
2003/0185415 A1 * 10/2003 Funahashi et al. ..... 381/398

(Continued)

FOREIGN PATENT DOCUMENTS

EP 1549107 A2 6/2005

(Continued)

OTHER PUBLICATIONS

Korean Office Action.

(Continued)

*Primary Examiner* — Curtis Kuntz
*Assistant Examiner* — Ryan Robinson
(74) *Attorney, Agent, or Firm* — Pearne & Gordon LLP

(57) ABSTRACT

Speaker damper (12) used in a speaker including frame (5), magnetic circuit (1) coupled to frame (5), voice coil unit (2) inserted into magnetic gap (8) provided in magnetic circuit (1), and diaphragm (3) coupled to frame (5) and voice coil unit (2) at its outer and inner peripheral ends, respectively. Speaker damper (12) is coupled to voice coil unit (2) and frame (5) at its inner and outer peripheral ends, respectively, and has first supporting portion (10) having a first elastic modulus at its inner peripheral end and second supporting portion (11) having a second elastic modulus different from the first elastic modulus at the outer peripheral side of first supporting portion (10). This configuration can reduce the distortion of a speaker, even if the amplitude amount of voice coil unit (2) becomes large, and a large load is not applied to vibrating voice coil unit (2).

8 Claims, 2 Drawing Sheets

U.S. PATENT DOCUMENTS

| | | | | |
|---|---|---|---|---|
| 2004/0165746 | A1 | 8/2004 | Kreitmeier et al. | |
| 2006/0215871 | A1 | 9/2006 | Funahashi et al. | |
| 2007/0154059 | A1* | 7/2007 | Ohara | 381/404 |

FOREIGN PATENT DOCUMENTS

| | | | |
|---|---|---|---|
| JP | 45-33465 | | 10/1970 |
| JP | 45-033465 | B | 10/1970 |
| JP | 56-049188 | Y | 11/1981 |
| JP | 2-133097 | | 11/1990 |
| JP | 02-133097 | U | 11/1990 |
| JP | 03-247099 | A | 11/1991 |
| JP | 11-150791 | | 6/1999 |
| JP | 2003-199192 | | 7/2003 |
| KR | 2003-22376 | | 3/2003 |
| WO | 02-102113 | | 12/2002 |
| WO | 2004/089037 | A1 | 10/2004 |

OTHER PUBLICATIONS

European Search Report for corresponding European application EP06798061 dated Oct. 19, 2010.

Japanese Office action dated Jul. 13, 2010 for Appl. No. 2006-131331.

* cited by examiner

PRIOR ART

SPEAKER DAMPER AND SPEAKER USING THE SAME

TECHNICAL FIELD

The present invention relates to a speaker damper and a speaker using the same.

BACKGROUND ART

As shown in FIG. 4, a conventional speaker includes voice coil unit 2*a*, magnetic circuit 1*a*, diaphragm 3*a* and frame 6*a*. Voice coil unit 2*a* is movably disposed in magnetic circuit 1*a*. Diaphragm 3*a* is coupled to voice coil unit 2*a* at its inner peripheral end and coupled to frame 6*a* via edge 4*a* at its outer peripheral end. Furthermore, voice coil unit 2*a* and frame 6*a* are coupled to each other by damper 6*a*.

Conventional damper 6*a* has a corrugated structure formed in a corrugated sheet with a material such as urethane, foamed rubber, SBR rubber, close, and the like. Such a corrugated structure secures a predetermined elastic modulus and suppresses the rolling occurring when voice coil unit 2*a* is driven. The above-mentioned conventional speaker is disclosed in, for example, Japanese Patent Unexamined Publication No. 11-150791.

Since damper 6*a* is formed in a corrugated structure, when the amount of amplitude of voice coil unit 2*a* is small, damper 6*a* is not loaded by the amplitude of voice coil unit 2*a*. However, as the amount of amplitude of voice coil unit 2*a* is increased, damper 6*a* is largely loaded by the amplitude of voice coil unit 2*a*. Therefore, the power linearity of the speaker shows nonlinearity, resulting in the generation of distortion of the speaker.

SUMMARY OF THE INVENTION

An object of the present invention is to provide a speaker damper capable of reducing the distortion of a speaker.

In order to achieve this object, a speaker damper of the present invention is coupled to the voice coil unit at its inner peripheral end and to the frame at its outer peripheral end, has a first supporting portion having a first elastic modulus at its inner peripheral side, and has a second supporting portion coupled to an outer peripheral side of the first supporting portion and having a second elastic modulus that is different from the first elastic modulus.

According to the speaker damper of the present invention, even if the amount of amplitude of the voice coil unit is increased, the speaker damper is not largely loaded by the vibration of the voice coil unit. Therefore, the distortion of the speaker can be reduced.

REFERENCE MARKS IN THE DRAWINGS

Figure 1:
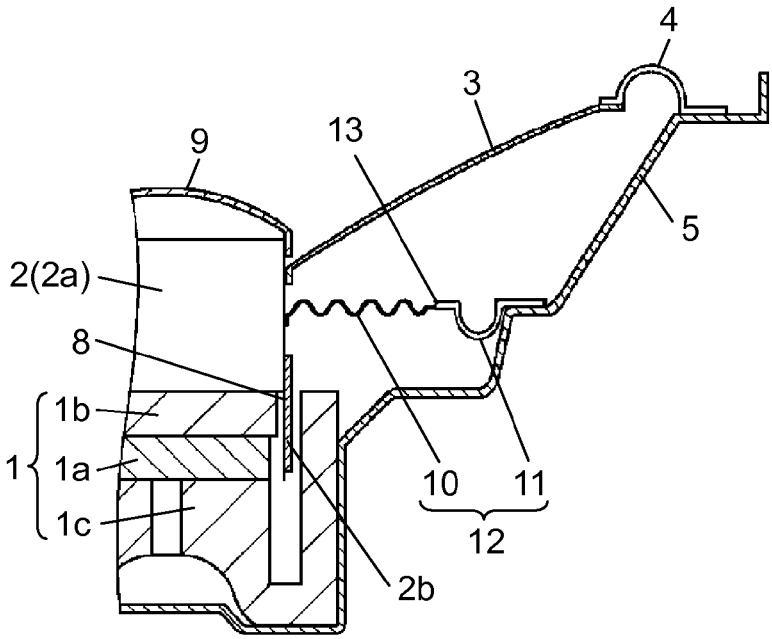
FIG. 1 is a partial sectional view showing a speaker in accordance with one exemplary embodiment of the present invention.

1 magnetic circuit
2 voice coil unit

3 diaphragm
4 edge (first edge)
5 frame
8 magnetic gap
10 damper
11, 11*a* edge (second edge)
12, 12*a* speaker damper
13 coupling portion

DETAILED DESCRIPTION OF THE PREFERRED EMBODIMENTS

FIG. 1 is a sectional view showing a speaker of the present invention. Magnetic circuit 1 is disposed in the middle of the bottom of bowl-shaped frame 5. Magnetic circuit 1 is constructed by combining and bonding disk-shaped magnet 1*a*, disk-shaped plate 1*b* and cylindrical yoke 1*c*. Between the inner peripheral side surface of the side wall of yoke 1*c* and the outer peripheral side surface of plate 1*b*, magnetic gap 8 opening upward in magnetic circuit 1 is formed.

Furthermore, voice coil unit 2 has a structure in which coil 2*b* is wound around the outer periphery of cylindrical main body 2*a*. Since voice coil unit 2 is inserted into magnetic gap 8 and disposed movably in the vertical direction with respect to magnetic gap 8, it can vibrate diaphragm 3 coupled to the upper outer peripheral part of voice coil unit 2. On the upper end of voice coil unit 2, dust cap 9 may be provided in order to prevent dust from entering.

Diaphragm 3, which is a sound generating source of a speaker, includes pulp and resin as a main material and has both high rigidity and internal loss. The outer peripheral end portion of diaphragm 3 is coupled to an open end portion of frame 5 via edge (first edge) 4 protruding in the vibration direction of diaphragm 3 (protruding upwards convex in FIG. 1). On the other hand, the inner peripheral end portion of diaphragm 3 is fixed to voice coil unit 2. Note here that first edge 4 is formed of a material such as urethane, foamed rubber, SBR rubber, and cloth in order that a moving load is not applied to diaphragm.

Speaker damper 12 includes damper 10 and edge (second edge) 11. That is to say, speaker damper 12 has disk-shaped corrugated structure damper 10 (an example of a first supporting portion having a first elastic modulus) at its inner peripheral side. To the outer peripheral side of damper 10, second edge 11 (an example of a second supporting portion having a second elastic modulus) is coupled.

The inner peripheral end of damper 10 is coupled to a part that is nearer to magnetic circuit 1 (lower side in FIG. 1) than a part of voice coil unit 2 to which diaphragm 3 is fixed. On the other hand, the outer peripheral end portion of damper 10 is coupled to frame 5 via second edge 11 protruding downward.

Damper 10 has a ring structure of corrugated sheet and can expand and contract in accordance with the movement of voice coil unit 2. Similar to first edge 4 provided on diaphragm 3, damper 10 is formed of a material that does not apply a load to vibrating diaphragm 3. An example of materials suitable for damper 10 includes urethane, foamed rubber, SBR rubber, cloth, and the like.

In the speaker having the above-mentioned configuration, when a sound signal is applied to coil 2*b* of voice coil unit 2, voice coil unit 2 responds to a magnetic field in magnetic gap 8 and vibrates in the vertical direction. With this vibration of voice coil unit 2, diaphragm 3 vibrates and sound is output from a speaker. At this time, speaker damper 12 is configured by providing second edge 11 on the outer peripheral end portion of damper 10. Thereby, the distortion of the speaker is suppressed and, furthermore, the driving efficiency of the speaker is enhanced.

Speaker damper 12 is coupled to frame 5 at its one end and coupled to voice coil unit 2 at another end. The role of speaker damper 12 is to suppress the rolling occurring at the time when voice coil unit 2 moves. In order to easily follow the movement of voice coil unit 2, speaker damper 12 is formed in a corrugated sheet and provided with elasticity.

Corrugated structure damper 10 does not give large load to movement of voice coil unit 2 when the amount of amplitude of voice coil unit 2 is small. However, as the amount of amplitude of voice coil unit 2 is increased, the load is increased. That is to say, as damper 10 may not deform sufficiently when the amount of amplitude of voice coil unit 2 is large, the load becomes large.

Therefore, in this exemplary embodiment, the outer periphery of damper 10 is coupled to frame 5 via second edge 11. With this configuration, when damper 10 is given load in accordance with the increase of the movement range (i.e. amount of amplitude) of voice coil unit 2, stress is applied to second edge 11 and second edge 11 is elastically deformed in accordance with the amount of this stress. When speaker damper 12 is configured in this way, even in the case where the amplitude of voice coil unit 2 is increased, with speaker damper 12, the amplitude is not easily diminished and the deterioration of the driving efficiency is suppressed.

Furthermore, in the case where second edge 11 starts to be deformed, since second edge 11 and first edge 4 protrude in the opposite directions, a difference between the upward load and downward load when diaphragm 3 vibrates in the vertical direction is small.*

In this way, since speaker damper 12 is provided with second edge 11 so as to suppress the increase in the vibration load and since first edge 4 and second edge 11 are constructed so that they protrude in the opposite direction, the difference in the vibration load in the vertical direction is not easily generated. As a result, a speaker with low distortion can be obtained.

In the speaker of this exemplary embodiment in which speaker damper 12 is coupled to frame 5 via second edge 11, the power linearity can be secured by damper 10 formed in a corrugated sheet until the amount of amplitude of voice coil unit 2 is increased to some extent. Furthermore, when the amount of amplitude of voice coil unit 2 becomes a predetermined value or more and the linearity cannot be secured easily, it is possible to compensate the linearity of power linearity by the elasticity of second edge 11. Therefore, it is desirable that the elasticity modulus of second edge 11 is set to be larger (more rigid) than the elastic modulus of corrugated structure damper 10.

Furthermore, it is desirable that corrugated structure damper 10 and second edge 11 have different elastic modulus respectively, so that they function independently in accordance with the amount of amplitude of voice coil unit 2. In order to do so, the elastic modulus between damper 10 and second edge 11, more specifically, the elastic modulus of coupling portion 13 of damper 10 and second edge 11 is set to larger (more rigid) than the elastic modulus of damper 10 or second edge 11, thereby securing independence between damper 10 and second edge 11. Herein, coupling portion 13 is a region where damper 10 and second edge 11 are overlapped with each other. As the state in which they are overlapped with each other, damper 10 and second edge 11 may be bonded together with adhesive or damper 10 may be inserted into the inside of second edge 11.

Specifically, in order to make the elastic modulus of coupling portion 13 of damper 10 and second edge 11 larger (more rigid) than the elastic modulus of damper 10 and second edge 11, for example, hard adhesive such as acrylic adhesive is preferably used as the kinds of adhesives for bonding second edge 11 and damper 10 together. Alternatively, second edge 11 and damper 10 are integrated with each other by insert molding so as to increase the thickness of coupling portion 13. Alternatively, a reinforcing material may be attached to coupling portion 13, thereby increasing the elastic modulus of coupling portion 13.

Furthermore, in order to secure the power linearity of diaphragm 3 that is a sound generation region of the speaker, each elastic modulus of damper 10 and second edge 11 is optimized. In addition, it is desirable to optimize the relation between speaker damper 12 combining damper 10 and second edge 11 and first edge 4 provided to diaphragm 3.

That is to say, the important point in this relation is how freely diaphragm 3 that is a substantial sound generation source of the speaker can vibrate in the up and down direction uniformly. When this point is considered, in order to make the most use of the linearity of diaphragm 3, it is desirable that the elastic modulus of speaker damper 12 combining damper 10 and second edge 11 is set to substantially equal to the elastic modulus of first edge 4 provided on diaphragm 3.

In order to do so, in this exemplary embodiment, as shown in FIG. 1, the dimension of second edge 11 is set smaller than that of first edge 4.

That is to say, since damper 10 has a corrugated structure and has small elastic modulus (i.e. damper 10 is soft), by making the size of second edge 11 smaller than that of first edge 4, the elastic modulus of second edge 11 is made to be larger (i.e. more rigid). Thereby, the elastic modulus of speaker damper 12 combining second edge 11 and damper 10 is allowed to approximate to the elastic modulus of first edge 4 as close as possible.

Diaphragm 3, voice coil unit 2 and speaker damper 12, which are located in a region between first edge 4 and second edge 11, can be regarded as an integrated rigid body. Therefore, when the interval between first edge 4 and second edge 11 is increased, the rolling of voice coil unit 2 can be suppressed and the distortion can be reduced. Then, in order to secure the interval between first edge 4 and second edge 11, first edge 4 is allowed to protrude in the direction opposite to damper 12 and second edge 11 is allowed to protrude in the direction opposite to diaphragm 3. Thereby, the interval between first edge 4 and second edge 11 is increased. Thus, the rolling of voice coil unit 2 can be suppressed and the distortion can be reduced.

Figure 2:
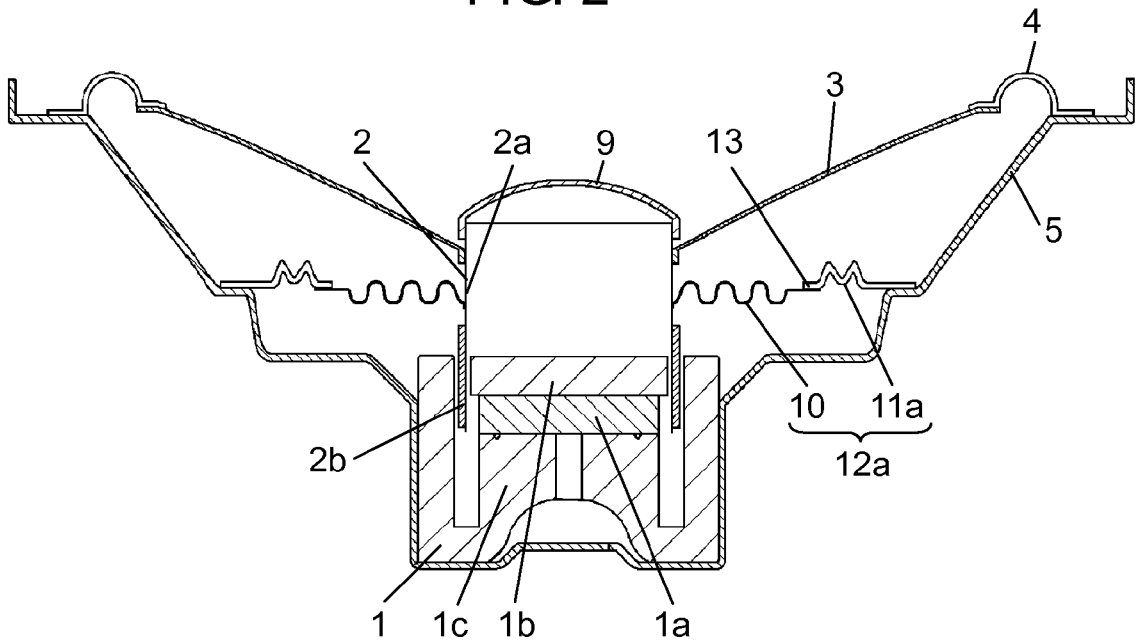
FIG. 2 is a sectional view showing a speaker in accordance with another exemplary embodiment of the present invention.
Figure 3:
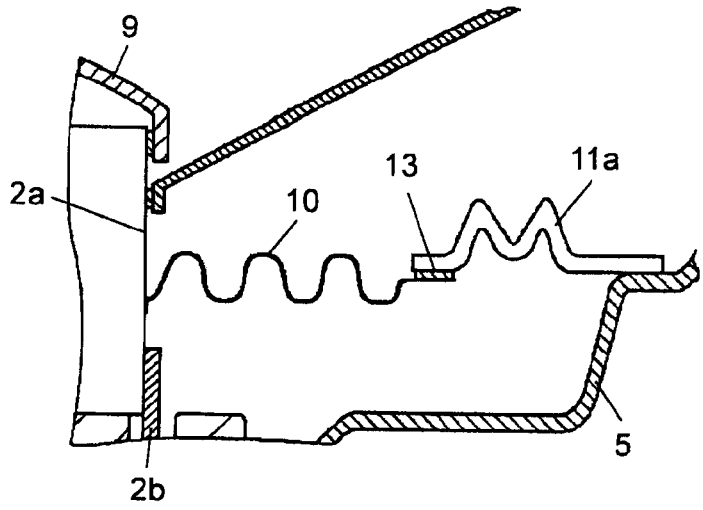
FIG. 3 is an enlarged sectional view showing a principal part of a speaker in accordance with another exemplary embodiment of the present invention.
Figure 4:
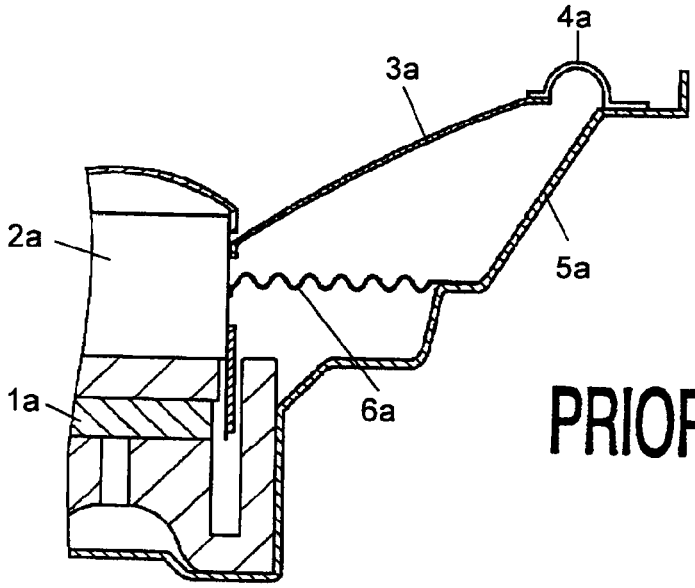
FIG. 4 is a partial sectional view showing a conventional speaker.

FIGS. 2 and 3 show another exemplary embodiment of the present invention. Herein, instead of second edge 11 shown in FIG. 1, second edge 11*a* (one example of the supporting portion) is provided.

Similar to first edge 4 provided on diaphragm 3, second edge 11*a* is formed of a material such as urethane, foamed rubber, SBR (Styrene-butadiene rubber) and cloth in order not to apply a load to diaphragm 3 at the time of vibration in the vertical direction. The second edge 11*a* does not have a semicircular cross sectional shape like second edge 11 shown in FIG. 1.

That is to say, in order that diaphragm 3 that is a substantial sound generation source of a speaker can vibrate freely uniformly in the vertical direction, it is desirable that the elastic modulus of speaker damper 12*a* combining damper 10 and second edge 11*a* is allowed to approximate to the elastic modulus of first edge 4 provided on diaphragm 3. In order to do so, similar to this exemplary embodiment, it is preferable that second edge 11*a* has a corrugated-sheet form rather than semicircular section. When second edge 11*a* is formed in a corrugated sheet, it is advantageous that the elastic modulus of speaker damper 12*a* is allowed to approximate to the elastic modulus of first edge 4 provided on diaphragm 3.

INDUSTRIAL APPLICABILITY

The present invention is useful for a speaker capable of reducing the distortion of the speaker and improving the driving efficiency. In particular, it is useful for a small-sized speaker.

The invention claimed is:

1. A speaker damper used for a speaker, the speaker comprising:

a frame:

a magnetic circuit supported by the frame;

a voice coil unit movably inserted into a magnetic gap provided in the magnetic circuit; and a diaphragm coupled to the frame at its outer peripheral end and coupled to the voice coil unit at its inner peripheral end; and the speaker damper, wherein the speaker damper has a first supporting portion having a first elastic modulus at its inner peripheral side, and has a second supporting portion coupled to an outer peripheral side of the first supporting portion, the second supporting portion having a second elastic modulus that is larger than the first elastic modulus, and the first supporting portion and the second supporting portion are formed separately, the inner peripheral end of the first supporting portion is coupled to the voice coil unit, and the outer peripheral end of the second supporting portion is coupled to the frame, and a part where the first supporting portion is coupled to the voice coil unit is nearer to the magnetic circuit than a part where the diaphragm is coupled to the voice coil unit.

2. The speaker damper of claim 1, further comprising a coupling portion of the first supporting portion and the second supporting portion, wherein an elastic modulus of the coupling portion is larger than the elastic modulus of the first supporting portion and the elastic modulus of the second supporting portion.

3. The speaker damper of any one of claims 1 and 2, further comprising an edge for coupling the diaphragm to the frame, wherein the first supporting portion has a corrugated structure, and the second supporting portion is formed of the same material as that of the edge.

4. A speaker comprising:

a frame:

a magnetic circuit supported by the frame;

a voice coil unit movably inserted into a magnetic gap provided in the magnetic circuit;

a diaphragm coupled to the frame at its outer peripheral end and coupled to the voice coil unit at its inner peripheral end; and a speaker damper, wherein the speaker damper has a first supporting portion having a first elastic modulus at its inner peripheral side, and a second supporting portion coupled to the first supporting portion, the second supporting portion having a second elastic modulus that is larger than the first elastic modulus at its outer peripheral side, and the first supporting portion and the second supporting portion are formed separately, the inner peripheral end of the first supporting portion is coupled to the voice coil unit, and the outer peripheral end of the second supporting portion is coupled to the frame, and a part where the first supporting portion is coupled to the voice coil unit is nearer to the magnetic circuit than a part where the diaphragm is coupled to the voice coil unit.

5. The speaker of claim 4, further comprising a coupling portion of the first supporting portion and the second supporting portion, wherein an elastic modulus of the coupling portion is larger than the elastic modulus of the first supporting portion and the elastic modulus of the second supporting portion.

6. The speaker of claim 4, further comprising a first edge for coupling an outer peripheral end of the diaphragm to an inner peripheral end of the frame, wherein the first edge protrudes in the direction in which the diaphragm vibrates, and the second supporting portion protrudes in the direction in which the diaphragm vibrates and in the direction opposite to the first edge.

7. The speaker of claim 4, further comprising a first edge for coupling an outer peripheral end of the diaphragm to an inner peripheral end of the frame, wherein an elastic modulus of the speaker damper is substantially equal to the elastic modulus of the first edge.

8. The speaker of claim 4, wherein the second supporting portion has a corrugated-sheet form.

* * * * *

UNITED STATES PATENT AND TRADEMARK OFFICE

CERTIFICATE OF CORRECTION

PATENT NO. : 8,085,970 B2
APPLICATION NO. : 11/573720
DATED : December 27, 2011
INVENTOR(S) : Osamu Funahashi It is certified that error appears in the above-identified patent and that said Letters Patent is hereby corrected as shown below:

IN THE SPECIFICATIONS:

In column 1, lines 11, 14, and 15 please delete “6a” and instead insert --5a--

Signed and Sealed this
Twenty-second Day of May, 2012

David J. Kappos

David J. Kappos
*Director of the United States Patent and Trademark Office*